US005174823A

United States Patent [19]

Dario

[11] Patent Number: 5,174,823

[45] Date of Patent: Dec. 29, 1992

[54] DEVICE FOR CONTROLLING THE AGGREGATIONS OF A MIXTURE OF STONE MATERIALS AND BINDERS FOR THE PRODUCTION OF AGGLOMERATED STONE PRODUCTS

[76] Inventor: Toncelli Dario, Via San Pancrazio 3, 36061 Bassano del Grappa (Vicenza), Italy

[21] Appl. No.: 698,541

[22] Filed: May 10, 1991

[30] Foreign Application Priority Data

May 16, 1990 [IT] Italy ..... 59342/90[U]

[51] Int. Cl.[5] ..... B05C 1/08; B05C 1/02

[52] U.S. Cl. ..... 118/249; 118/258

[58] Field of Search ..... 241/227; 425/363, 90, 425/93; 118/249, 258, 222; 427/218, 220, 428; 264/245

[56] References Cited

U.S. PATENT DOCUMENTS

| | | | |
|---|---|---|---|
| 275,835 | 4/1883 | Marmon | 241/145 |
| 294,418 | 3/1884 | Wegmann | 241/232 |
| 641,985 | 1/1900 | McAnulty | 241/232 |
| 1,083,033 | 12/1913 | Rossberg | 241/230 |
| 1,663,762 | 3/1928 | Johnson | 425/93 |
| 1,766,892 | 6/1930 | Fisher | 427/218 |
| 1,772,188 | 8/1930 | Mason | 241/230 |
| 1,931,754 | 10/1933 | Denning | 427/218 |
| 2,143,498 | 1/1939 | Reichert | 241/232 |
| 2,194,511 | 3/1940 | Sonsthagen | 241/167 |
| 2,235,968 | 3/1941 | Thurman | 241/230 |
| 2,252,389 | 8/1941 | Vincke . | |
| 2,592,048 | 4/1952 | Linden | 241/232 |
| 2,676,563 | 4/1954 | Montgomery et al. | 118/249 |
| 2,695,851 | 11/1954 | Lodge | 427/218 |
| 2,925,226 | 2/1960 | Pratique | 241/227 |
| 2,969,193 | 1/1961 | Ball et al. | 241/166 |
| 3,197,147 | 7/1965 | Krohne | 241/227 |
| 3,455,725 | 7/1969 | Jex et al. | 427/220 |
| 3,476,058 | 11/1969 | Watkin et al. | 425/363 |
| 3,478,972 | 11/1969 | Hansen | 241/230 |
| 3,606,265 | 9/1971 | Cobey | 241/230 |
| 3,758,249 | 9/1973 | Newby | 425/363 |
| 4,146,354 | 3/1979 | Kohl | 425/363 |
| 4,285,890 | 8/1981 | Mizutani et al. | 264/338 |
| 4,503,096 | 3/1985 | Specht | 427/428 |
| 4,683,814 | 8/1987 | Plovanich et al. | 241/227 |
| 4,709,864 | 12/1987 | Henne et al. | 241/230 |
| 4,847,029 | 7/1989 | Dietrich et al. | 425/363 |
| 4,905,910 | 3/1990 | Wuestner | 241/230 |
| 4,923,126 | 5/1990 | Ludovico | 241/166 |
| 5,054,701 | 10/1991 | Durinck | 241/167 |

FOREIGN PATENT DOCUMENTS

| | | | |
|---|---|---|---|
| 0060211 | 2/1913 | Austria | 241/166 |
| 0066802 | 10/1914 | Austria | 241/167 |
| 19148 | 10/1903 | Belgium | 241/167 |
| 0524140 | 5/1954 | Belgium | 425/363 |
| 54-155258 | 12/1979 | Japan . | |
| 1398585 | 6/1975 | United Kingdom . | |

*Primary Examiner*—Willard Hoag
*Attorney, Agent, or Firm*—McAulay Fisher Nissen Goldberg & Kiel

[57] ABSTRACT

In a device for controlling the aggregations of a mixture of stone materials and binders for the manufacturing of agglomerated stone products, two cylindrical rollers having parallel axes are rotated at different rotation speeds and the distance between said axes is adjustable in order to determine the maximum size of the aggregations.

17 Claims, 2 Drawing Sheets

DEVICE FOR CONTROLLING THE AGGREGATIONS OF A MIXTURE OF STONE MATERIALS AND BINDERS FOR THE PRODUCTION OF AGGLOMERATED STONE PRODUCTS

The present invention relates to a device for limiting and controlling the concentrations or aggregations of a mixture of stone materials and binders for the manufacturing of composite stone products.

It is well known that by a composite stone a product is meant formed by stone materials bonded by either organic or inorganic polymers or by cement. The stone materials can be of varying nature, for example granite, quartz, silica sand, porphyry, basalt, marble, chamotte, ceramic materials and others. The nature and the grain size of the stone materials and the type of binder are selected as a function of the aesthetical aspects sought for and of the functions to be fulfilled by the final product.

Generally the composite stone products are obtained by dosing, within proper mixing apparatus a given amount of stone materials, having a predetermined particle size, with a given amount of a binder; the composite material or mixture is admixed for a certain time in order to achieve the desired uniformity and then discharged into a proper mold to form blocks or plates.

Within the mold the mixture may undergo a treatment of vibration and pressing under vacuum for the compaction thereof, and at the end the product is obtained which, after a sufficient seasoning period, may be subjected to further finishing treatments before the final use (grinding, polishing, size cutting, bevelling, etc.).

In the case in which stone materials are used having a very fine particle size, (about 1 to 3 mm.), for example for the manufacturing of plates having an uniform pattern, it is necessary to use a greater amount of binder with respect to the case of use of greater particle sizes, since these finer particles show a greater exposed surface.

Consequently under these circumstances there are originated local concentrations or aggregations of stone granulates and binder which are difficulty integrated with the remaining mixture, whereby the uniformity of pattern/colour sought for is lost.

In order to eliminate this drawback or at least reduce its effects, it has been attempted to modify the mixing process, by adjusting the mixing times, by differently dosing the several ingredients, or by other types of intervention, but these attempts have not lead to results valuable under the industrial point of view, for which the economical features of the problem cannot be neglected.

The purpose of the present invention is that of doing away with the above drawbacks in terms acceptable from the economical-industrial point of view.

Thus the object of the present invention is a device for controlling the aggregations in a mixture of stone materials and binders, characterized by comprising two cylindrical rollers having axes parallel to each other, said rollers having different rotation speeds, the distance between said axes being adjustable to define the maximum size of the aggregations present in the final product.

Preferably said rollers have independent rotation speeds, obtained by means of separate motor means.

According to a preferred embodiment the device comprises furthermore at least a tank containing colouring oxides to be transferred to the surface of at least one of said rollers.

More particularly the transfer of the colouring oxides is carried out by gravity or alternatively by dipping.

According to a further embodiment the device comprises also a dividing wall element located at the outlet of said rollers, said wall element being preferably in form of a blade.

BRIEF DESCRIPTION OF THE DRAWINGS

The specific features and the advantages of the present invention shall appear more clearly from the following description of a preferred embodiment, having no limiting purpose, with reference to the accompanying drawings, in which.

Figure 1:
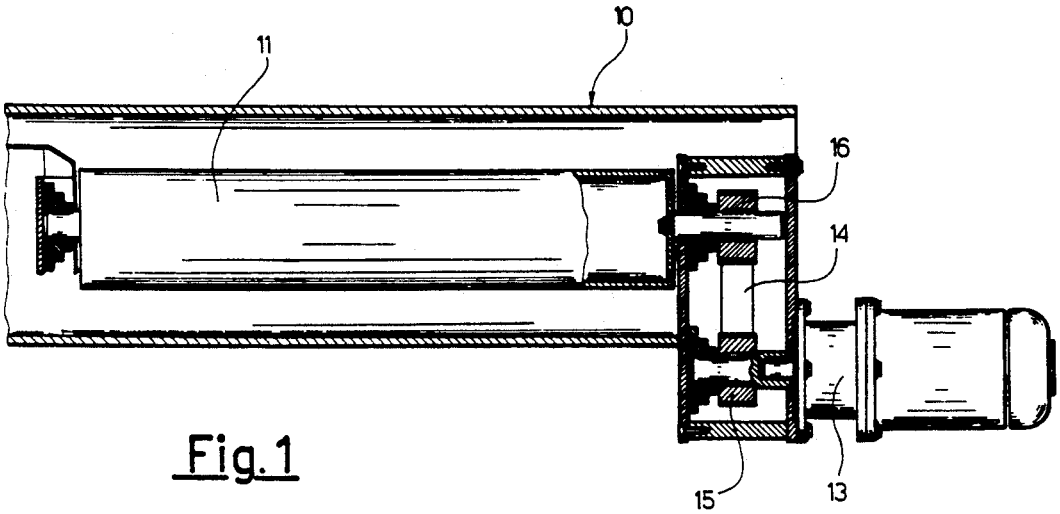
FIG. 1 represents a front view of the device according to the present invention.
Figure 2:
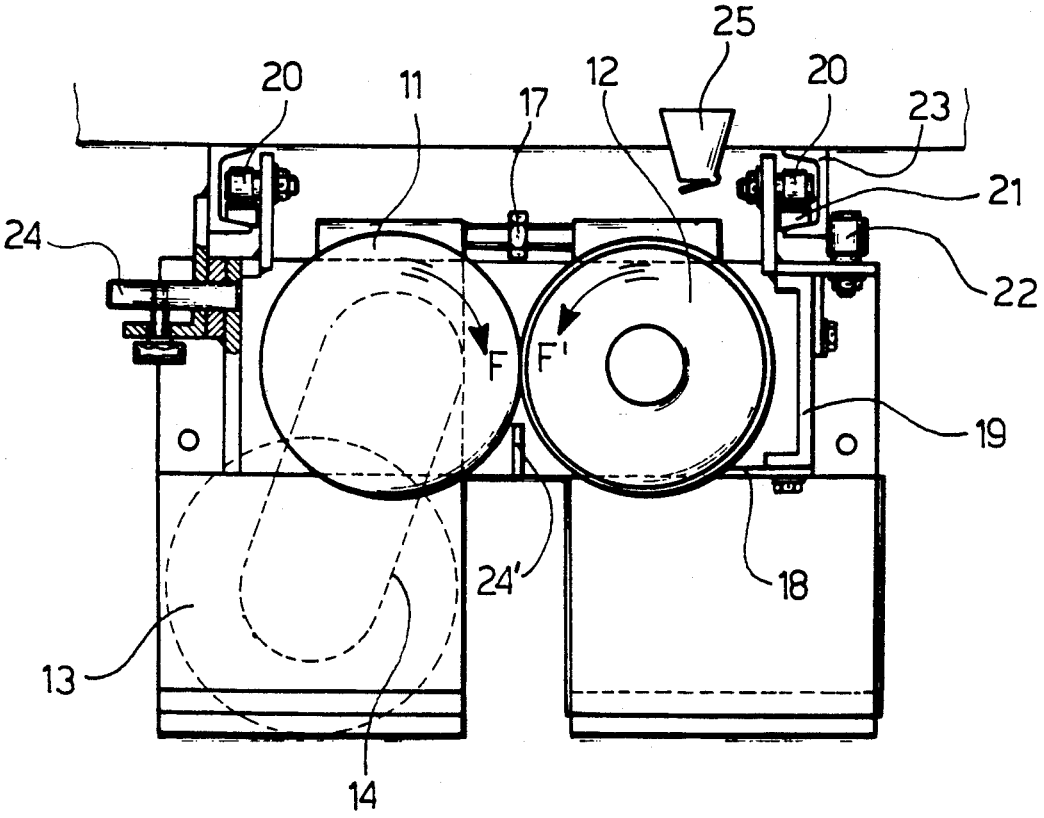
FIG. 2 is a side view of the device of FIG. 1.

With reference to the FIGS. 1 and 2, 10 indicates the device for eliminating local concentrations or aggregations of stone granules and of binders; it comprises two cylindrical steel rollers 11 and 12, the axes of which are parallel and spaced from each other.

The surface of the two rollers is perfectly smooth and preferably chromium plated.

Each cylinder is driven by its own motor gear 13 and 13' (the latter being not shown), which through a toothed belt 14 engages two pulleys, respectively 15 the driving one and 16 the driven one, whereby the related roller 11 is driven into rotation in the direction indicated by the arrow F.

The number of rotations per unit time of the roller 11 is thus well defined from the reduction ratio of the motor gear and of the belt transmission.

The cylindrical roller 12 rotates in the direction indicated by the arrow F' and the number of rotations per minute thereof is different, for example higher than that of the roller 11, whereby the mixture fed from above between the cylinders 11 and 12 undergoes a creeping action besides that of rolling, thus inducing a self-cleaning action of the roller rotating at the higher speed. It is thus preferably to periodically invert the rotation speeds of the two rollers in order to ensure the self-cleaning of both.

The spacing between the axes of the two cylindrical rollers can be adjusted by operating the screw 17.

At the lower part of each cylindrical roller there are located the doctor blades 18 and 18' (the latter being not shown) consisting of a rigid steel blade, which provide for the cleaning of the cylindrical roller rotating at low speed from possible residues of binder and of granules.

The two cylindrical rollers 11 and 12 and the related motor means 13, 14, 15 and 16, are housed within a supporting structure 19, provided with wheels 20, the latter abutting onto rails 21 so that it is possible to displace the entire device in the direction of the longitudinal axes of the rollers 11 and 12.

The roller 22 and the outer surface of the C shaped profile 23 are the guide means for said displacement.

The displacement of the two rollers with the related motor means and the supporting structure permits the device to be put out of line in order to facilitate the cleaning and the maintenance of the device itself and of the place normally occupied therefrom. This displacement can be carried out manually by means of the handle 24, or automatically by means of motor driven means (not shown).

The device 10 is furthermore provided with a blade 24' (or alternatively with a wire or a series of wires), placed below the two rollers where the generatrix lines of said rollers are closest to each other; said blade or said wires can be put into tension by proper tensioning means (not shown) having the purpose of dividing the mixture of composite material coming out from the rollers, when it is desired to increase the feeding rate by increasing the distance of the axes of the two rollers without loosing the function of the device itself.

The device 10 can be positioned in any position between the outlet of the mixing equipments and the feeding to the distribution station of the mixture within the mold, the latter being then advanced to the forming process (for example a treatment of vibration and pressing under vacuum). The mixture, consisting of granules and binders, coming from the mixing equipment is fed between the rollers 11 and 12, the spacing between the axes thereof having been previously set with respect to the parameters of the mixture to be treated (quantity, particle size of the granules, type of binder, etc.) The combined action of the different peripheral speeds of the two rollers and of the selected spacing between the axes of said rollers cause controlled creeping within the mixture mass by which the concentration or aggregation constancy of the mixture coming out from the rollers is ensured.

It the above described device is added with a tank 25 containing colouring oxides (for instance of the types known for the use in the colouring of stone based products, such as metal oxides), these can be made to drop onto the surface of either roller (or of both rollers) for their transfer to the mixture in a fully random manner, whereby the thus obtained products has coloured veins with special chromatic effects.

The transfer of the coloured oxides can be also carried out manually or by dipping into a tank placed below either roller.

Although the device according to the present invention has been described with reference to a preferred embodiment, possible modifications or changes of this embodiment are considered to fall within the patentable scope of the present invention, limited only by the claims.

I claim:

1. A device for the control of aggregations of a mixture of stone materials and binders, comprising:

two cylindrical rollers having parallel axes;

said cylindrical rollers rotating at different and adjustable rotation speeds; and means maintaining said cylindrical rollers free of contact with each other and for adjusting the distance between said axes being adjustable in order to determine the maximum size of the aggregations present in the final products which pass freely between said cylindrical rollers; and at least one tank containing coloring oxides, and means for transferring said coloring oxides from said tank to the surface of at least one of said rollers.

2. The device according to claim 1, including a separate motor means for each said roller for driving each said roller at independent different rotation speeds.

3. The device according to claim 1, including means for conveying said coloring oxides onto a surface of at least one of said rollers.

4. The device according to claim 1, comprising a tank containing coloring oxides and means for passing one of said rollers through said tank as said roller rotates.

5. A device for controlling aggregations of a mixture of stone aggregate materials and binders for the production of agglomerated stone products, comprising:

a pair of spaced rollers, each rotatable on its own axis;

means for varying exit spacing between said rollers, said varying means while varying the exit spacing also maintaining said rollers free of contact with each other;

said varying means determining the maximum size of the aggregations; and individual motor means coupled with each said roller for controlling the speed of each of said rollers while maintaining a relative speed difference between the speed rotation of each of said rollers.

6. The device of claim 5, including a separate doctor blade for each said roller for cleaning thereof in either direction of rotation about its respective axis.

7. The device of claim 5, including a supporting structure for housing said individual motor means and said rollers, said supporting structure including tracks for cooperation with wheels associated with said rollers for displacement of said rollers and said motor means in a direction of the longitudinal axes of each of said rollers.

8. The device of claim 5, wherein the axes of each of said rollers lie in a plane normal to the direction of feed of said aggregations, and said nip lying in the plane of the axes of said rollers, said axes being parallel to each other.

9. The device of claim 5, wherein the direction of rotation of each of said rollers is controlled by said motor means.

10. The device of claim 5, wherein said means for varying the exit spacing of said rollers includes means at an outlet of a nip spacing of said rollers for dividing a mixture of the composite material exiting from between said rollers.

11. The device of claim 10, wherein said means for varying the exit spacing between said rollers includes means for controlling a free pathway for exiting of said aggregate material.

12. The device of claim 5, wherein said means for varying the exit spacing between said rollers includes means coupled with each of said rollers for controlling a nip spacing between said rollers.

13. The device of claim 12, wherein said means for controlling said nip spacing varies the distance between said rollers by varying the distance between the axes of said rollers.

14. The device of claim 12, wherein said means for varying the exit spacing of said rollers includes means at an outlet of a nip spacing of said rollers for dividing a mixture of the composite material exiting from between said rollers.

15. The device of claim 14, wherein said means for varying the exit spacing between said rollers includes means for controlling a free pathway for exiting of said aggregate material.

16. A device for the control of aggregations of a mixture of stone materials and binders, comprising:

two cylindrical rollers having parallel axes and a wall dividing element positioned at an outlet of said rollers;

said cylindrical rollers rotating at different and adjustable rotation speeds; and means maintaining said cylindrical rollers free of contact with each other and for adjusting the distance between said axes being adjustable in order to determine the maximum size of the aggregations present in the final products which pass freely between said cylindrical rollers.

17. The device according to claim 16, wherein said wall element is a blade.

* * * * *